US007158166B2

(12) United States Patent
Futakami et al.

(10) Patent No.: US 7,158,166 B2
(45) Date of Patent: Jan. 2, 2007

(54) OPTICAL PRINTER HEAD HAVING LIQUID CRYSTAL SHUTTER

(75) Inventors: Shigeru Futakami, Tokorozawa (JP); Sadao Masubuchi, Chofu (JP); Toshiaki Uchida, Sayama (JP)

(73) Assignee: Citizen Watch Co., Tokyo (JP)

( * ) Notice: Subject to any disclaimer, the term of this patent is extended or adjusted under 35 U.S.C. 154(b) by 302 days.

(21) Appl. No.: 10/497,912

(22) PCT Filed: Mar. 17, 2003

(86) PCT No.: PCT/JP03/03164

§ 371 (c)(1),
(2), (4) Date: Jun. 7, 2004

(87) PCT Pub. No.: WO03/078170

PCT Pub. Date: Sep. 25, 2003

(65) Prior Publication Data

US 2005/0024475 A1 Feb. 3, 2005

(30) Foreign Application Priority Data

Mar. 19, 2002 (JP) ..... 2002-075631
Mar. 26, 2002 (JP) ..... 2002-084642

(51) Int. Cl.
*B41J 27/00* (2006.01)
*B41J 2/45* (2006.01)
*F21V 5/00* (2006.01)

(52) U.S. Cl. ..... 347/257; 347/238; 362/330

(58) Field of Classification Search ..... 347/257, 347/238, 245; 396/374; 359/871; 362/330
See application file for complete search history.

(56) References Cited

U.S. PATENT DOCUMENTS 4,560,264 A * 12/1985 Kitazawa et al. ..... 396/374
5,363,294 A * 11/1994 Yamamoto et al. ..... 362/330
6,195,196 B1 2/2001 Kimura et al.
2002/0030903 A1* 3/2002 Lu ..... 359/871

FOREIGN PATENT DOCUMENTS

JP 62050775 * 3/1987
JP 63-57764 4/1988
JP 04-156354 5/1992
JP 2000-275644 10/2000
JP 2000-309124 11/2000
JP 2000-343758 12/2000
JP 2001013602 * 1/2001
JP 2001-313387 11/2001

* cited by examiner

*Primary Examiner*—Hai Pham
*Assistant Examiner*—Carlos Martinez, Jr.
(74) *Attorney, Agent, or Firm*—Smith, Gambrell & Russell, LLP

(57) ABSTRACT

A leaf spring (52) and adjusting screws (53*a*, 53*b*) are arranged in opposite positions on the inner wall surface of a liquid crystal shutter housing recess (42*c*) that is formed in a frame body (42) of an optical printer head (41). The position and posture of the liquid crystal shutter (45) in the liquid crystal shutter housing recess (42*c*) is adjusted with respect to an opening (42*a*) of the frame body (42) by turning the adjusting screws (53*a*, 53*b*).

13 Claims, 9 Drawing Sheets

OPTICAL PRINTER HEAD HAVING LIQUID CRYSTAL SHUTTER

TECHNICAL FIELD

The present invention relates to an optical printer head, of which a liquid crystal shutter having a linear pixel column serves to expose a photoconductor to an image.

BACKGROUND ART

An optical printer head is known in which a photoconductor, such as an instant film, is exposed to an image to record it with use of a linear liquid crystal shutter. An example of a scanning head that includes this optical printer head was applied for a patent in Japan (Serial No. 2001-313387). FIG. 13 is a sectional view of the optical printer head described in this patent application, and FIG. 14 is a perspective view of an optical printer that is fitted with the optical printer head.

In FIG. 13, an optical printer head 5 comprises a frame body 12, light source 9, liquid crystal shutter 11, light guide plate 14, cushion 19, head top cover 21, lens array 13, etc. The frame body 12 supports individual parts. The light source 9 is composed of a plurality of light emitting diodes (LED's) 9*a*, 9*b* and 9*c*. The liquid crystal shutter 11 is set in the frame body 12. The light guide plate 14 linearly converges light from the light source 9. The cushion 19 presses down the light guide plate 14 from above. The head top cover 21 overspreads the liquid crystal shutter 11. The lens array 13 is formed of a plurality of lens groups that are set in the lower part of the frame body 12.

The liquid crystal shutter 11 and the light source 9 are connected electrically to each other by means of a head-side electrode 31 of a flexible connecting member 7. The flexible connecting member 7 is made to range from a side face 5*a* of the optical printer head 5 to a lower surface 5*e* and is turned back at a turning portion 24. Further, the turned flexible connecting member 7 is fixed to the frame body 12 by means of the elastic force of a spring 26. The end portion of the flexible connecting member 7 opposite from the head-side electrode 31 is provided with a joint-side electrode 32 for connection with an external circuit.

In the optical printer shown in FIG. 14., a scanning head 2 and a control board 3 that has a control circuit are stored in an outer case 1. Attached to the lower part of the outer case 1 is a photoconductor cassette 4 that can be drawn out in the direction indicated by arrow A. A photoconductor top portion 8 of the photoconductor cassette 4 is situated under the scanning head 2.

The scanning head 2 is provided with the optical printer head 5 shown in FIG. 13, two rod-shaped guide members 6 that support the optical printer head 5 for reciprocation in the direction of arrow A of FIG. 14, and the flexible connecting member 7 that is drawn out from the side face 5*a* of the optical printer head 5 and fixed by means of the spring 26. The scanning head 2 is connected electrically to the control board 3 by means of a curved portion 7*b* of the flexible connecting member 7. Further, the optical printer head 5 has a structure such that it is movable on and along the guide members 6 by means of support portions 5*c* and 5*d* that are formed on its lateral parts with respect to its moving direction (direction indicated by arrow A in FIG. 14).

The operation of this prior art example will now be described with reference to FIGS. 13 and 14. When the control board 3 delivers control signals to the light source 9 and the liquid crystal shutter 11 through the flexible connecting member 7, the light source 9 successively emits lights of three colors, red, green, and blue. Based on image data from the control board 3, the liquid crystal shutter 11 selectively turns on and off a linear pixel column (not shown), and an image of one line is formed for exposure on the photoconductor top portion 8 of the photoconductor cassette 4 through the medium of a linear light receiving surface of the lens array 13 that is situated right under the linear pixel column.

Then, the control board 3 drives a scanning motor (not shown) to move the optical printer head 5 for one line in the direction of arrow A in FIG. 14. Thereafter, the control board 3 controls the light source 9 and the liquid crystal shutter 11 to perform exposure operation for the next line, whereupon the photoconductor top portion 8 of the photoconductor cassette 4 is exposed to an image of the next line. By repeating this operation thereafter, the photoconductor top portion 8 of the photoconductor cassette 4 is exposed to an image for one picture.

Since the resolution of the optical printer normally ranges from about 200 to 300 dpi, the linear pixel column of the liquid crystal shutter 11 is very narrow, having a width of 100 μm or thereabout. If the light receiving surface of the lens array 13 that receives lights from the pixel column of the liquid crystal shutter 11 is substantially as wide as the pixel column, the liquid crystal shutter 11 sometimes may be slightly shifted in the left-right direction in FIG. 13, owing to distortion of the external shape of the frame body 12 or errors in the external dimensions of the liquid crystal shutter 11. Thereupon, the lights transmitted through the linear pixel column of the liquid crystal shutter 11 are entirely deviated from the center of the light receiving surface of the lens array 13. Some of these lights are intercepted by the frame body 12, so that the exposure of the photoconductor is reduced considerably and the image 15, quality worsens.

The above problem may possibly be avoided by making the width of the light receiving surface of the lens array 13 greater enough than the pixel column width. If the light receiving surface of the lens array 13, which is formed of a plurality of groups of lenses in the form of a very thin rod each, is widened, the lens groups are considerably increased in number, so that the manufacturing cost is inevitably rendered very high. If the wide lens array is attached to an optical head printer, moreover, the external size of the head and the head weight increase, constituting a substantial hindrance to the realization of a small-sized, lightweight optical printer.

In the optical printer head 5 shown in FIG. 13, furthermore, the lens array 13 is formed of a large number of arrays of lens elements that form erect equimultiple images. It is designed so that the distance from the light receiving surface or a lens end face on the incident light side to the an object surface is equal to the distance from the light emitting surface or a lens end face on the emitted light side to an imaging surface. This is defined as the imaging distance of the lens array. If the object surface or imaging surface (e.g., photoconductor top portion 8 of FIG. 14) is situated in a position accurately corresponding to the imaging distance, a focused, high-resolution image can be formed. If the object surface or imaging surface is situated off the imaging distance, on the other hand, a defocused, low-resolution image is formed.

In the lens array 13 that receives transmitted lights from the liquid crystal shutter 11 and forms an image, in FIGS. 13 and 14, its object surface is a liquid crystal cell substrate of the liquid crystal shutter 11, and its imaging surface is the photoconductor top portion 8. In order to obtain a high-quality image with high resolution, therefore, the distance from the liquid crystal cell substrate surface of the liquid crystal shutter 11 to the light receiving surface of the lens array 13 and the distance from the light emitting surface of the lens array 13 opposite the light receiving surface to the photoconductor top portion 8 must be made accurately equal to the imaging distance of the lens array 13.

However, the liquid crystal shutter 11 of the conventional optical printer head has a structure such that a polarizing plate is put on a liquid crystal cell substrate that is formed of a glass member and coated with an adhesive agent. It is housed directly in a liquid crystal shutter housing recess 12*a* that is formed in the frame body 12. Therefore, the polarizing plate engages the bottom of the liquid crystal shutter housing recess 12*a*. Thus, the polarizing plate that is coated with the adhesive agent exists between the liquid crystal cell substrate and the lens array 13. While the polarizing plate normally has a thickness of hundreds of micrometers or thereabout, the thickness finely varies depending on variation in manufacture, and the thickness of the adhesive agent spread on the polarizing plate also finely varies depending on the state of application. Since the polarizing plate is a resin sheet that has elasticity, moreover, the thickness of the adhesive agent varies after the polarizer is put on the liquid crystal cell substrate, due to a difference in pressure that is produced when it is adhesively bonded to the cell board. Owing to these factors combined together, the distance between the liquid crystal cell substrate surface of the liquid crystal shutter 11 and the light receiving surface of the lens array 13 undergoes an error for each optical printer head. In consequence, the imaging distance of the lens array 13 differs from the distance from the liquid crystal cell substrate surface of the liquid crystal shutter 11 to the light receiving surface of the lens array 13. Therefore, the image that is formed on the photoconductor top portion 8 inevitably undergoes exposure as a defocused, low-resolution image. Thus, the image quality is lowered considerably.

Since the optical printer head is simple in construction, furthermore, it can be miniaturized relatively easily and should be in demand as an article for a mobile printer. Thus, its vertical thickness is expected to be minimized.

DISCLOSURE OF THE INVENTION

The present invention has been made in view of these problems, and its object is to provide an optical printer head, in which the respective center positions of a linear pixel column of a liquid crystal shutter and a narrow lens array can be aligned without using a wide lens array.

An optical printer head according to the present invention for exposing a photoconductor to an image comprises a liquid crystal shutter and a frame body that houses the liquid crystal shutter. The frame body includes a base portion having an opening through which light passes and a liquid crystal shutter housing recess formed over the base portion. Further, an elastic body and an adjusting screw are located on one and the other, respectively, of two opposite wall surfaces of the liquid crystal shutter housing recess. Thus, the elastic body and the adjusting screw are used to adjust the position and attitude of the liquid crystal shutter in the liquid crystal shutter housing recess.

The optical printer head according to the present invention may assume the following aspects.

The frame body has a lens array housing portion in a position corresponding to the opening through which light passes under the base portion.

The elastic body that is located in the liquid crystal shutter housing recess abuts against a part of the liquid crystal shutter housed in the liquid crystal shutter housing recess. More specifically, it abuts against a substantially central portion of the liquid crystal shutter.

A plurality of adjusting screws are arranged in the liquid crystal shutter housing recess. More specifically, the adjusting screws are two in number and are located individually in two symmetrical points in a position where the elastic body abuts against the; liquid crystal shutter.

The liquid crystal shutter has a linear pixel column, and the lens array has a linear light receiving surface. The position of the liquid crystal shutter is adjusted so that the respective lines of the liquid crystal shutter and the lens array are coincident with each other.

The liquid crystal shutter is connected with a flexible connecting member for connection with an external circuit. The flexible connecting member is led out from one wall surface side of the liquid crystal shutter housing recess. The elastic body is located on the wall surface of the liquid crystal shutter housing recess on the side from which the flexible connecting member is led out, and the adjusting screw is located on the wall surface on the opposite side.

The liquid crystal shutter has a structure such that a polarizing plate smaller than a liquid crystal cell substrate is put on the liquid crystal cell substrate. Further, the bottom portion of the liquid crystal shutter housing recess is formed with a polarizing plate housing recess large enough to house the polarizing plate. The polarizing plate is adapted to be housed in the polarizing plate housing recess so that the liquid crystal cell substrate comes intimately into contact with the bottom portion of the liquid crystal shutter housing recess when the liquid crystal shutter is housed in the liquid crystal shutter housing recess.

The frame body is covered by a retaining cover. The retaining cover is formed with an opening containing a light source, a light guide for linearly converging light from the light source, a plurality of reflecting sheets covering the surface of the light guide, and a spacer member having elasticity to press the light guide toward the light source.

One of the reflecting sheets is a reflecting sheet for covering the top face and the opposite side portions of the light guide plate, formed by cutting two slits in one sheet material so as to extend in the longitudinal direction thereof and then inwardly squarely turning the opposite side portions thereof.

The inner wall of the opening in the retaining cover is formed with recesses for receiving the insertion-side corner portions of the reflecting sheet.

The reflecting sheet is stuck to that surface of the spacer member which faces the light guide.

According to the optical printer head of the present invention, constructed in this manner, the respective positions of a linear pixel column of the liquid crystal shutter and the linear lens array corresponding to the opening can be adjusted precisely and easily by means of a plurality of adjusting screws. If shape distortion of the frame body or an external shape error of the liquid crystal shutter is caused, therefore, transmitted light from the liquid crystal shutter can be accurately irradiated to the center of the light receiving surface of the lens array without being attenuated, so that exposure for a high image quality can be realized.

BEST MODE FOR CARRYING OUT THE INVENTION

An optical printer head according to a first embodiment of the present invention will first be described with reference to FIGS. 1 to 4.

Figure 1:
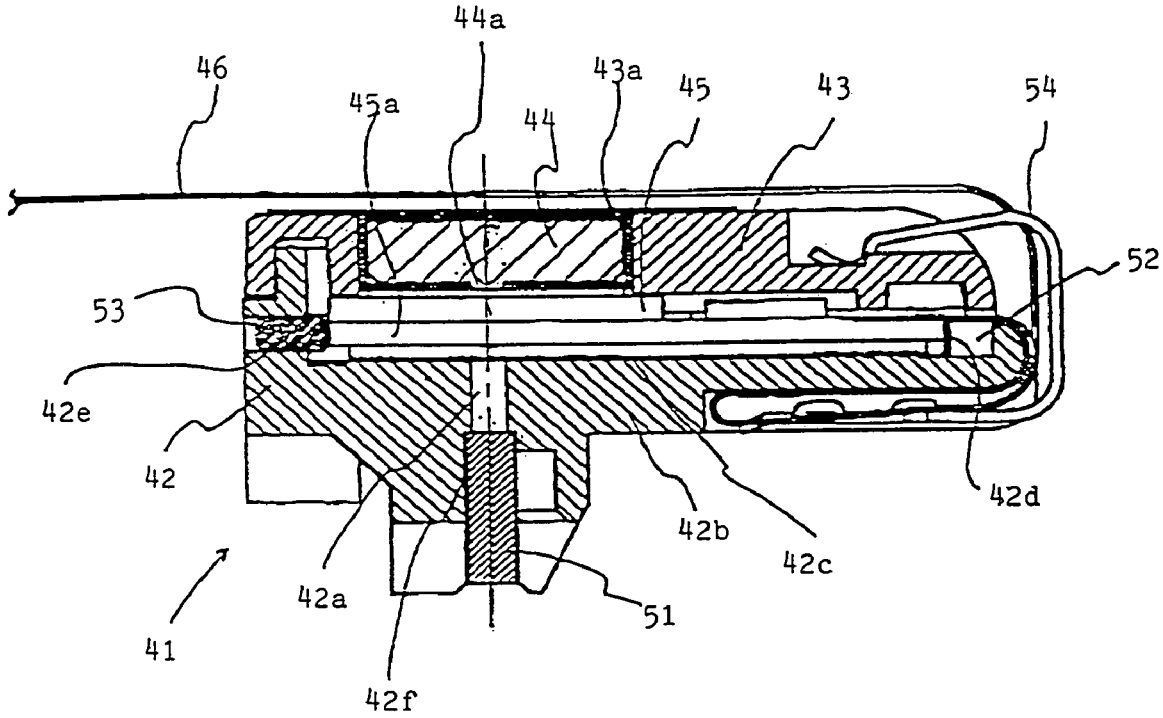
FIG. 1 is a profile of an optical printer head according to a first embodiment of the present invention.
Figure 13:
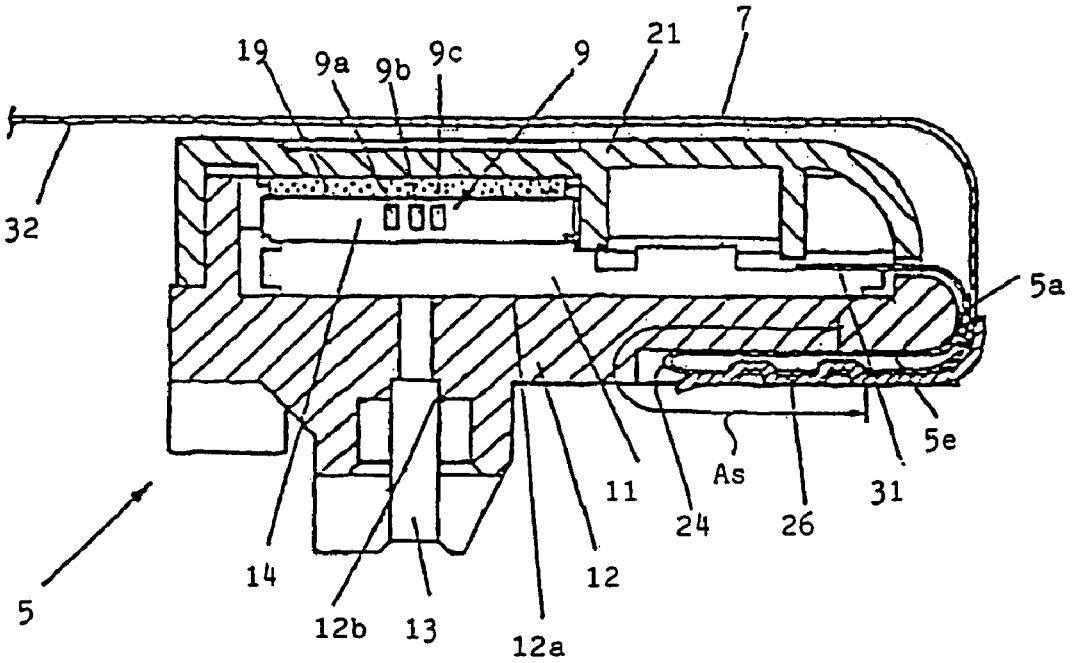
FIG. 13 PRIOR ART
FIG. 13 is a profile of a conventional optical printer head.

FIG. 1 is a sectional view of the optical printer head according to the present embodiment. Since it shares the basic configuration with the conventional optical printer head 5 shown in FIG. 13, a description of the configurations of duplicate portions will be omitted.

In FIG. 1, reference numerals 41, 42 and 43 denote the optical printer head, a frame body, and a retaining cover, respectively. The frame body 42 comprises a base portion 42*b*, having an opening 42*a* through which the lights pass, and a liquid crystal shutter housing recess 42*c* formed over the base portion 42*b*. Further, one of two opposite wall surfaces of the liquid crystal shutter housing recess 42*c* is provided with an elastic body holding portion 42*d*, and the other with a tapped hole 42*e* for adjustment. Underlying the base portion 42*b*, furthermore, a lens array housing portion 42*f* is provided in a position corresponding to the opening 42*a*.

A liquid crystal shutter 45 is housed in the liquid crystal shutter housing recess 42*c* of the frame body 42. A leaf spring 52, an elastic body that is held in an elastic body holding portion 42*d*, abuts against one side of a glass substrate 45*a* that constitutes the liquid crystal shutter 45, while two adjusting screws 53 that are screwed in the tapped hole 42*e* for adjustment abut against the other side. The leaf spring 52 and the adjusting screws 53 constitute a position adjusting mechanism (explained later) for the liquid crystal shutter 45. Further, a lens array 51 is positioned and held in a lens array housing portion 42*f*.

A light source 44 that linearly emits a plurality of luminescent colors is housed in an opening 43*a* of the retaining cover 43. A light emission window 44*a* that is formed on the undersurface of the light source 44 is positioned so as to face the opening 42*a* of the frame body 42. The light source 44 shown in FIG. 1 (and FIG. 5) is equivalent to the aforementioned combination of the aforesaid light source 9, which is formed of the plurality of light emitting diodes (LED's) 9*a*, 9*b* and 9*c*, and the light guide plate 14 that linearly converges the light from the light source 9 shown in FIG. 13.

The liquid crystal shutter 45, the light source 44, and an external circuit (not shown) are connected electrically to one another by means of a flexible connecting member 46. This flexible connecting member 46 is led out of that side of the glass substrate 45*a* of the liquid crystal shutter 45 which is engaged by a retainer spring 54.

After individual elements are housed in the frame body 42 and the retaining cover 43, the frame body 42 and the retaining cover 43 are caused to engage each other and are fixed by means of the spring force of the retainer spring 54, whereupon the optical printer head 41 is completed. In this state, the position adjusting mechanism (leaf spring 52 and adjusting screws 53) for the liquid crystal shutter 45 and the flexible connecting member 46 are relatively positioned in the following manner. The leaf spring 52 is located on the exit side for the flexible connecting member 46, and the adjusting screws 53 on the opposite side. Thus, position and posture adjustment (mentioned later) of the liquid crystal shutter can be carried out without being hindered by the flexible connecting member 46.

The operation of the optical printer head 41 will now be described with reference to FIG. 1. When the external circuit (not shown) supplies a control signal to the flexible connecting member 46, the light source 44, which is connected electrically to the flexible connecting member 46, successively emits linear lights of three colors, red, green, and blue, through the light emission window 44*a* in response to the control signal, and irradiates the liquid crystal shutter 45 with them.

The liquid crystal shutter 45 receives image data from the external circuit and alternatively on/off-controls a linear pixel column. In consequence, the linear lights that are modulated by the liquid crystal shutter 45 pass through the opening 42*a* that is situated right under the liquid crystal shutter 45, and land on a linear light receiving surface of the lens array 51. Thereupon, an image of one line is exposed to a photoconductor (not shown) that is located at a given distance from the lens array 51.

The optical printer head 41 is moved for each line on the photoconductor by means of a scanning motor (not shown). Thereupon, the light source 44 and the liquid crystal shutter 45 are caused by the external circuit to repeat exposure operation in synchronism with the motion of the scanning motor, so that the photoconductor can enjoy plane exposure to the image.

Figure 2:
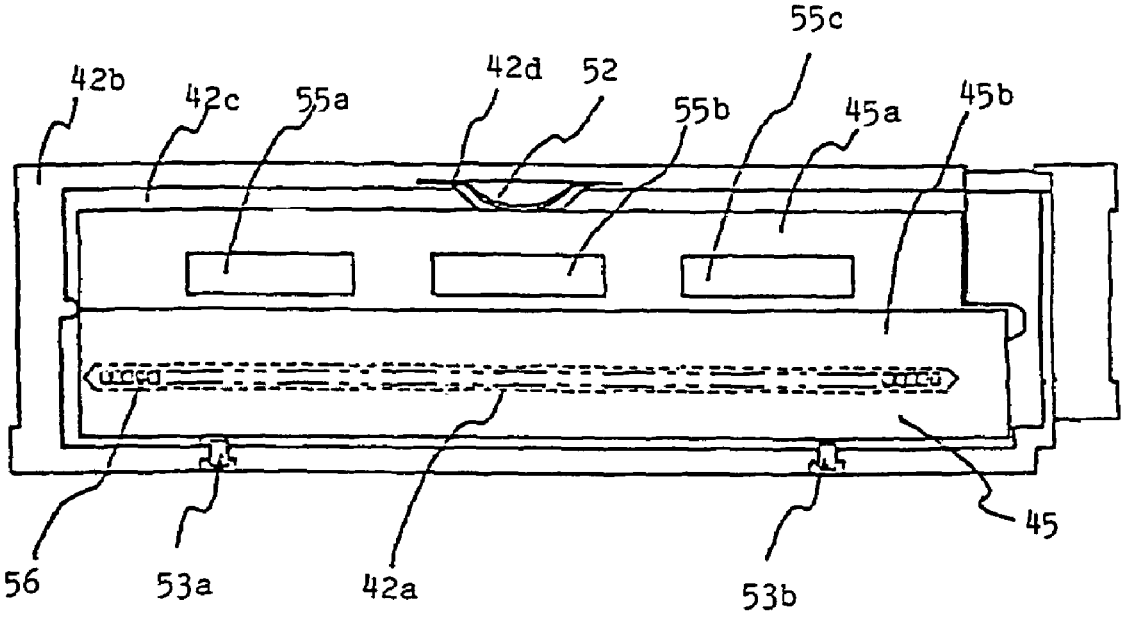
FIG. 2 is a top view showing the positional relation between a liquid crystal shutter and a frame body of the optical printer head of FIG. 1.

FIG. 2 is a top view showing a state in which the liquid crystal shutter 45 shown in FIG. 1 is housed in the liquid crystal shutter housing recess 42*c* that is formed over the base portion 42*b*. In this drawing, the leaf spring 52 that is held in the elastic body holding portion 42*d* abuts substantially against the center of one side of the glass substrate 45*a* that constitutes the liquid crystal shutter 45. On the other hand, the respective distal ends of two adjusting screws 53*a* and 53*b* that are screwed in the tapped hole 42*e* for adjustment abut against the other side (or the side opposite from the side against which the leaf spring 54 abuts) of the glass substrate 45*a*.

The liquid crystal shutter 45 is constructed so that a liquid crystal is sealed between the glass substrate 45*a* having a larger configuration and a glass substrate 45*b* having a smaller configuration. Reference numeral 56 denotes a linear pixel column that is formed on the liquid crystal shutter 45. Further, reference numerals 55*a*, 55*b* and 55*c* denote driver ICs that are mounted on those parts of the glass substrate 45*a* which do not constitute the liquid crystal shutter. They receive image data from the flexible connecting member 46 and drive a linear pixel column 56 that is formed on the liquid crystal shutter 45.

Figure 3A:
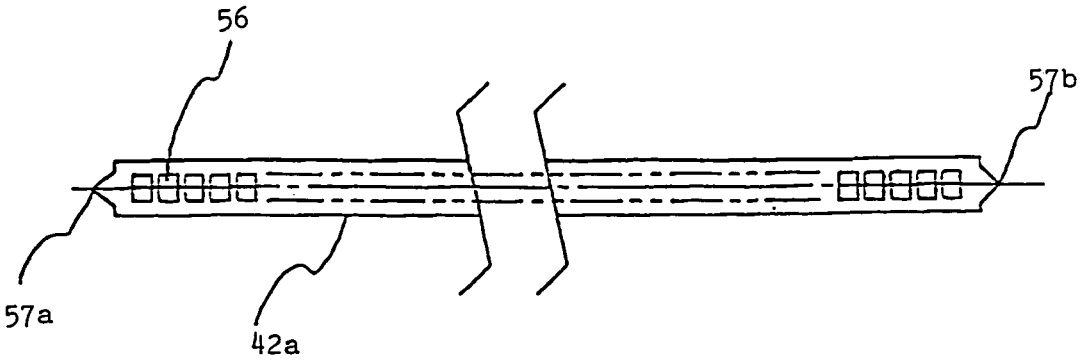
FIG. 3A is an enlarged top view showing the positional relation between a pixel column and an opening linearly formed in the liquid crystal shutter and the frame body, respectively, of FIG. 2.

FIG. 3A is an enlarged top view showing the positional relation between the linear pixel column 56 and the linear opening 42*a*. As shown in this drawing, the width of the opening 42*a* of the frame body 42 is a little greater than the width of the pixel column 56 of the liquid crystal shutter 45. Further, the opposite ends of the opening 42*a* project outward, and their respective projected ends 57*a* and 57*b* are situated on the center line of the opening 42*a*.

As shown in FIG. 1, moreover, the lens array 51 is housed in that part of the lens array housing portion 42*f* which corresponds in position to the opening 42*a* of the frame body 42.

If the liquid crystal shutter 45 is housed in a right position and posture in the liquid crystal shutter housing recess 42*c*, the respective centers of the pixel column 56 and the opening 42*a* are coincident, as shown in FIG. 3A, so that all lights that are emitted from the pixel column 56 pass through the opening 42*a* and reach the center position of the light receiving surface of the lens array 51 without a hitch. In consequence, the lens array 51 can correctly apply the received lights to the photoconductor so that it is exposed to an appropriate image.

If the shape of the liquid crystal shutter housing recess 42*c* in the frame body 42 is slightly distorted or if the glass substrate 45*a* that constitutes the liquid crystal shutter 45 is subject to a slight error in dimensions, however, the position and posture of the liquid crystal shutter 45 are shifted in the liquid crystal shutter housing recess 42*c*. In consequence, the respective centers of the pixel column 56 and the opening 42*a* of the frame body 42 are inevitably dislocated with respect to each other.

If the liquid crystal shutter 45 is dislocated with respect to the opening 42*a* of the frame body 42 in the liquid crystal shutter housing recess 42*c*, then the center line of the pixel column 56 will fail to coincide with the center line of the lens array 51 so that it slants with respect to the center line of the lens array 51. This point will now be described with reference to FIG. 3B.

Figure 3B:
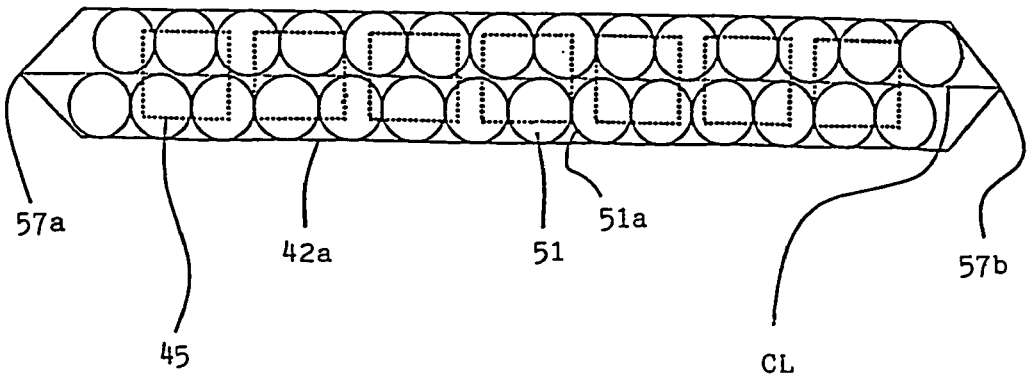
FIG. 3B is a schematic representation showing the positional relation between the pixel column formed on the liquid crystal shutter of FIG. 1 and a lens array.

FIG. 3B shows an arrangement of the lens array 51, as viewed from the opening 42*a* in the base portion 42*b* of the frame body 42. This lens array 51 is formed by bundling two columns of optical fibers 51*a*. The luminous energy distribution of the lens array 51 has its maximum in an area corresponding to a center line CL and becomes lower with distance from the center line CL. This implies that lights transmitted through the pixel column 56 are evenly incident upon the lens array 51 if the liquid crystal shutter 45 is located such that the center line of its pixel column 56 is coincident with the center line CL of the lens array 51. If the lights transmitted through the pixel column 56 are evenly incident upon the lens array 51, lights emitted from the lens array 51 are also even. In FIG. 3B, the pixel column 56 of the liquid crystal shutter 45 is indicated by broken lines. In this drawing, the center line of the pixel column 56 is coincident with the center line CL of the lens array 51.

If the liquid crystal shutter 45 is dislocated so that the center line of the pixel column 56 is inclined with respect to the center line CL of the lens array 51, in contrast with this, some of the lights that are transmitted through the pixel column 56 are incident upon the end side of the lens array 51. These lights incident upon the end side of the lens array 51 are influenced by the luminous energy distribution of the lens array, so that the lights emitted from the lens array 51 are uneven and inevitably exert a great influence upon the image quality.

According to the present invention, however, as the optical printer head that uses the lens array 51 is provided with the position adjusting mechanism for the liquid crystal shutter 45, the position and posture of the liquid crystal shutter 45 can be adjusted such that the center line of its pixel column 56 is coincident with the center line CL of the lens array 51. Thus, a high image quality can be maintained continually.

Figure 4:
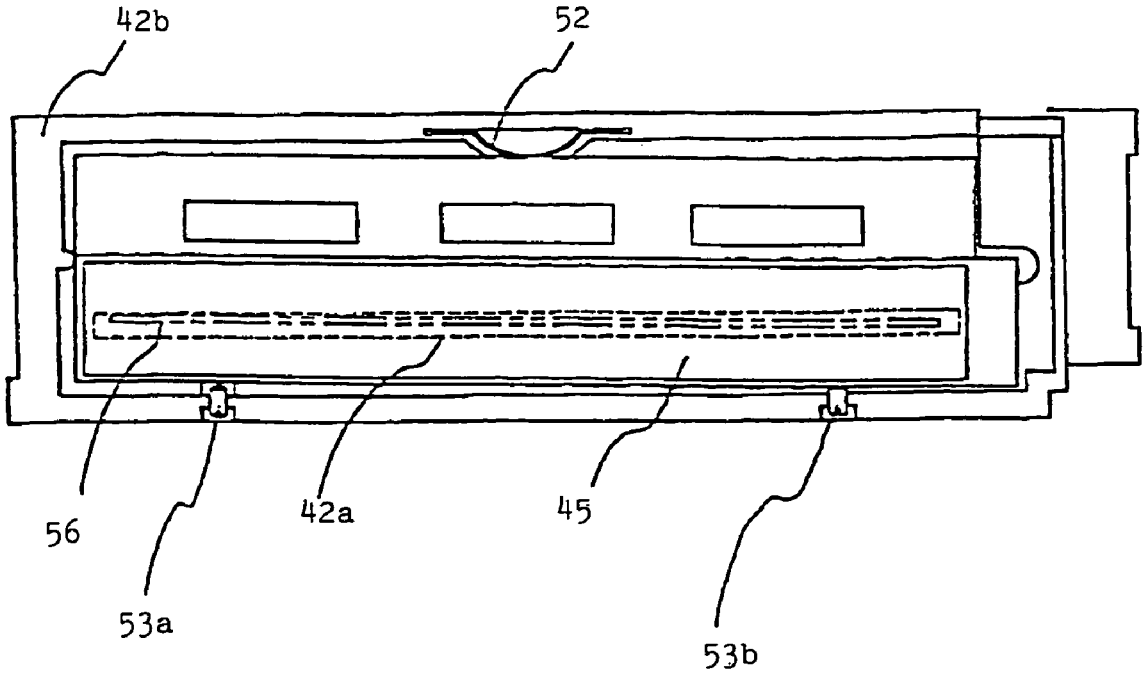
FIG. 4 is a top view showing the positional relation between the liquid crystal shutter and the frame body of the optical printer head of FIG. 1.

FIG. 4 illustrates the way the liquid crystal shutter 45 shown in FIG. 1 is dislocated when it is housed in the liquid crystal shutter housing recess 42*c*. In the example shown in FIG. 4, the liquid crystal shutter 45 is dislocated in a manner such that it slants downward to the right with respect to the opening 42*a* in the base portion 42*b*.

When the liquid crystal shutter is dislocated in this manner, the lights emitted from the pixel column 56 are irradiated to positions off the center of the light receiving surface of the lens array 51, and some of the lights hit the wall surface of the opening 42*a* or the like. In consequence, the lights that reach the light receiving surface of the lens array 51 are reduced, so that the photoconductor cannot be exposed correctly.

The following is a description of operation for the position adjustment of the liquid crystal shutter 45 by means of the position adjusting mechanism. Before mounting the light source 44 and the lens array 51 in assembling the optical printer head 41, the pixel column 56 of the liquid crystal shutter 45 is visually recognized from the side of the opening 42*a* of the frame body 42 that contains the liquid crystal shutter 45, and the adjusting screws 53*a* and 53*b* are turned by means of a miniature driver or the like. By doing this, the dislocation of the pixel column 56 and the opening 42*a* with respect to each other can be corrected.

Thus, if the liquid crystal shutter 45 is dislocated downward to the right, as shown in FIG. 4, the adjusting screw 53*a* on the left-hand side of the liquid crystal shutter 45 is turned counterclockwise to move the left-hand side of the liquid crystal shutter 45 slightly downward, while the adjusting screw 53*b* on the right-hand side is turned clockwise to move the right-hand side of the liquid crystal shutter 45 slightly upward. By doing this, the pixel column 56 and the opening 42*a* are adjusted so that their respective centers are coincident with each other. Thus, with use of the two screws (53*a*, 53*b*) as the adjusting screws 53 that constitute the position adjusting mechanism for the liquid crystal shutter, the liquid crystal shutter 45 can be translated in the opening

42*a*, and besides, the liquid crystal shutter 45 can be rocked clockwise and counterclockwise.

As this is done, the leaf spring 52 is situated on the wall surface of the glass substrate 45*a* that faces the adjusting screws 53*a* and 53*b*, and partially holds a substantially central portion of the glass substrate 45*a*. With a slight movement of the adjusting screws 53*a* and 53*b*, therefore, the position of the liquid crystal shutter 45 can be adjusted equally left and right by means of the spring force of the leaf spring 52.

The state shown in FIGS. 2 and 3A is a state in which the position adjustment of the pixel column 56 and the opening 42*a* is completed by the adjustment with the adjusting screws 53*a* and 53*b*.

Since the lens array housing portion 42*f* of the frame body 42 corresponds to the opening 42*a*, the respective centers of the opening 42*a* and the light receiving surface of the lens array 51 are coincident with each other, in consequence. Therefore, aligning the respective centers of the pixel column 56 and the opening 42*a* is equivalent to aligning the respective centers of the pixel column 56 and the light receiving surface of the lens array 51. Further, the projected ends 57*a* and 57*b* at the opposite ends of the opening 42*a* are aligned with the center line of the opening 42*a* when they are positioned correctly. Therefore, an operator who carries out the position adjustment by means of the adjusting screws 53*a* and 53*b* can visually adjust the two projected ends 57*a* and 57*b* and the pixel column 56 of the liquid crystal shutter 45 by comparison, thereby aligning their respective centers with ease.

Although the linear pixel column 56 of the liquid crystal shutter 45 is a single column according to the present embodiment, it may be replaced with two or more columns or a zigzag pixel column. Further, the adjusting screws according to the present embodiment are two in number. Depending on the construction, however, they may be three or more in number. Although the elastic body (leaf spring 52) is one number, moreover, a plurality of adjusting screws may be used instead.

According to the optical printer head of the present embodiment, as seen from the above description, the respective positions of the linear pixel column of the liquid crystal shutter and the linear lens array corresponding to the opening can be adjusted precisely and easily by means of a plurality of adjusting screws. If shape distortion of the frame body or an external shape error of the liquid crystal shutter is caused, therefore, the transmitted lights from the liquid crystal shutter can be accurately irradiated to the center of the light receiving surface of the lens array without being attenuated, so that exposure for a high image quality can be realized. In the optical printer head of the present embodiment, moreover, the lens array that is formed of a plurality of lens groups is expected only to have a light receiving surface of a width that is equal to or a little greater than the pixel column width of the liquid crystal shutter. Therefore, the lens array, which is expensive, can be considerably lowered in cost, and besides, the optical printer head can be positively reduced in size and in weight. Further, the flexible connecting member that receives the external control signal is located on the side opposite from the wall surface on which the adjusting screws are arranged. If the flexible connecting member extends long from the optical printer head, therefore, it never hinders the operator's manipulation of the adjusting screws. Thus, there may be provided the optical printer head that ensures reliable adjustment operation.

A position adjusting mechanism according to a second embodiment of the present invention will now be described with reference to FIGS. 5 to 8.

Figure 5:
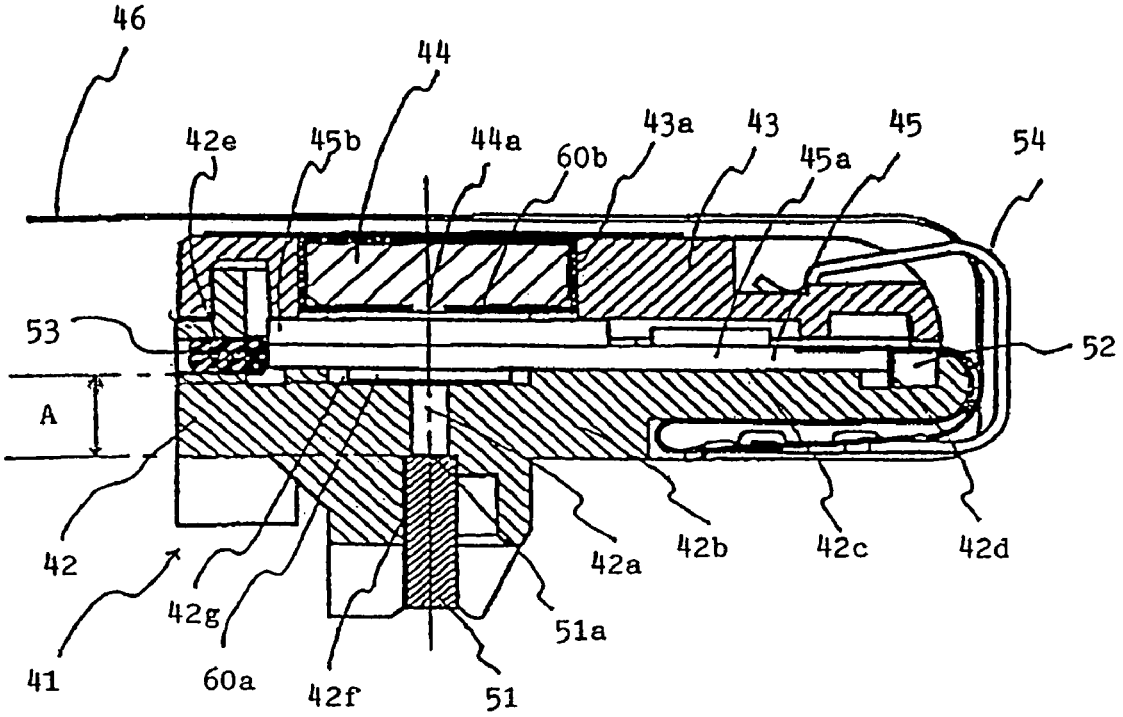
FIG. 5 is a profile of an optical printer head according to a second embodiment of the present invention.

FIG. 5 is a sectional view of the optical printer head according to the present embodiment. Since it shares the basic configuration with the optical printer head shown in FIG. 1 (and FIG. 13), a description of the configurations of duplicate portions will be omitted.

Figure 8:
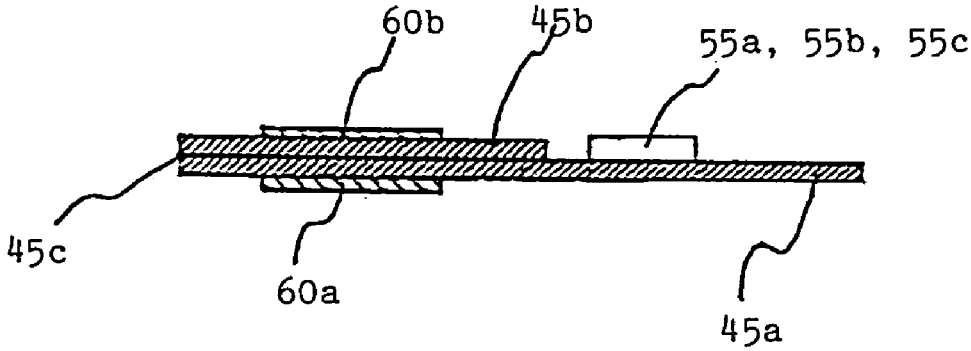
FIG. 8 is a sectional view of the liquid crystal shutter taken along line B—B of FIG. 6.

The optical printer head of FIG. 5 differs from the optical printer head of FIG. 1 in that its liquid crystal shutter 45 has the construction shown in FIG. 8. More specifically, in the liquid crystal shutter 45, as shown in FIG. 8, a wide liquid crystal cell substrate 45*a* and a narrow liquid crystal cell substrate 45*b* are stuck to each other, and a polarizing plate 60*a* having a shape smaller than that of the wide liquid crystal cell substrate 45*a* is put on the liquid crystal cell substrate 45*a* with an adhesive agent between them. On the other hand, a polarizing plate 60*b* having a shape smaller than that of the narrow liquid crystal cell substrate 45*b* is also put on the liquid crystal cell substrate 45*b* with the adhesive agent between them.

With the liquid crystal shutter 45 having the construction shown in FIG. 8, the bottom portion of a liquid crystal shutter housing recess 42*c* of a base portion 42*b* of a frame body 42 is formed with a second recess 42*g* that is a little greater in thickness (depth) and area than the polarizing plate 60*a*.

The following is a description of the way the liquid crystal shutter 45 is housed in the liquid crystal shutter housing recess 42*c* of the base portion 42*b*. Since the liquid crystal shutter 45 has the polarizing plate 60*a* (FIG. 8) put on its liquid crystal cell substrate 45*a*, it has a projection corresponding to the thickness of the polarizing plate 60*a*. As shown in FIG. 5, however, the second recess 42*g* is formed in the bottom portion of the liquid crystal shutter housing recess 42*c*, so that the polarizing plate 60*a* on the liquid crystal cell substrate 45*a* is housed in the second recess 42*g*. In consequence, the liquid crystal cell substrate 45*a* is intimately in contact with the bottom portion of the liquid crystal shutter housing recess 42*c* when the liquid crystal shutter 45 is housed in the liquid crystal shutter housing recess 42*c*.

Further, a leaf spring 52, an elastic body that is held in an elastic body holding portion 42*d*, abuts against one side of the liquid crystal cell substrate 45*a* of the liquid crystal shutter 45, while the respective distal ends of two adjusting screws 53 that are screwed in a tapped hole 42*e* for adjustment abut against the other side of the liquid crystal cell substrate 45*a*. The leaf spring 52 and the adjusting screws 53 constitute a position adjusting mechanism for the liquid crystal shutter 45, which is similar to the position adjusting mechanism according to the first embodiment.

The positional relation between the liquid crystal shutter 45 and a lens array 51 will now be described with reference to FIG. 5. A distance A between the liquid crystal cell substrate 45*a* of the liquid crystal shutter 45 and a light receiving surface 51*a* of the lens array 51 should be accurately equalized to an imaging distance proper to the lens array 51. According to the present embodiment, as shown in FIG. 5, the polarizing plate 60*a* that is put on the liquid crystal cell substrate 45*a* is housed in the second recess 42*g* that is formed in the bottom portion of the liquid crystal shutter housing recess 42*c*. Therefore, the distance A cannot be influenced by the thickness of the polarizing plate 60*a* or the thickness of the fixative with which the polarizing plate 60*a* and the liquid crystal cell substrate 45*a* are bonded together. Thus, the distance A is settled depending on the shape and size of the base portion 42*b* only.

Since the distance A is equal to the distance from the bottom surface of the liquid crystal shutter housing recess 42*c* in the base portion 42*b* to the lower end of an opening 42*a*, the shape of the base portion 42*b* can be determined so that the distance A is equal to the imaging distance of the lens array 51. Since the frame body 42 that includes the base portion 42*b* can be precisely molded by means of a die, in particular, the distance A and the imaging distance of the lens array 51 can be made accurately equal to each other.

Figure 6:
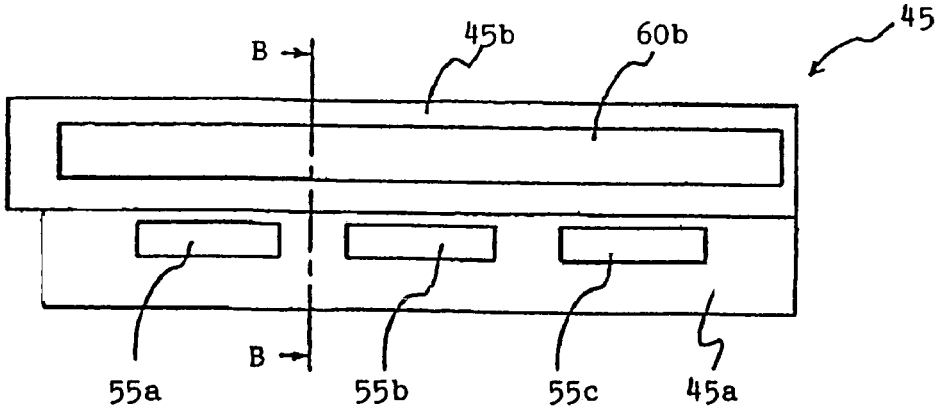
FIG. 6 is a top view of a liquid crystal shutter of the optical printer head of FIG. 5.

FIG. 6 is a top view of the liquid crystal shutter 45 shown in FIGS. 5 and 8. The liquid crystal shutter 45 is formed by sticking the two liquid crystal cell substrates 45*a* and 45*b* together. The polarizing plate 60*b* is put on the liquid crystal cell substrate 45*b* so as to cover a pixel column (not shown) that is formed on the liquid crystal cell substrate 45*b*. Further, driver ICs 55*a*, 55*b* and 55*c* that drive the liquid crystal shutter are mounted on those parts of the liquid crystal cell substrate 45*a* which do not overlap the liquid crystal cell substrate 45*b*.

Figure 7:
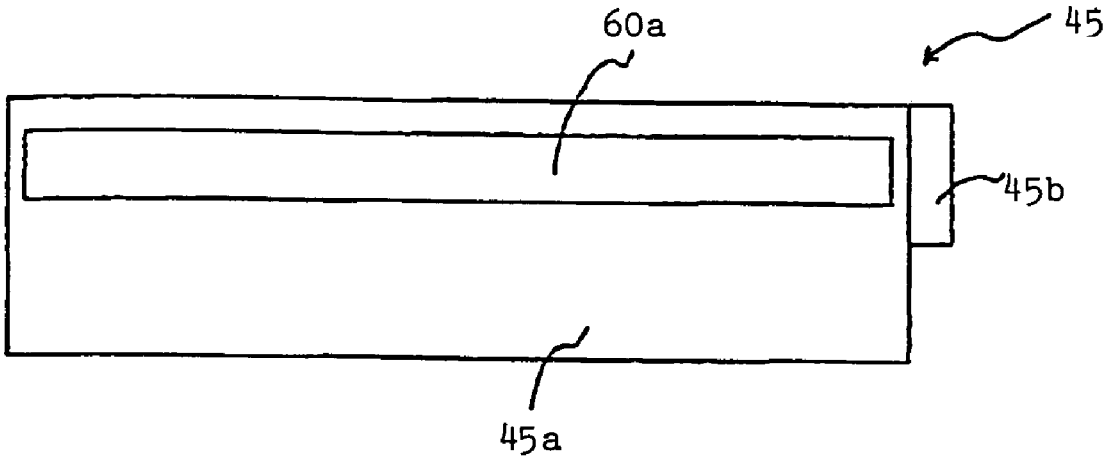
FIG. 7 is a bottom view of the liquid crystal shutter of FIG. 6.

FIG. 7 is a bottom view of the liquid crystal shutter 45 shown in FIG. 6. The polarizing plate 60*a* is put on the liquid crystal cell substrate 45*a* of the liquid crystal shutter 45 so as to cover a pixel column (not shown) that is formed on the liquid crystal cell substrate 45*a*.

FIG. 8 is a sectional view of the liquid crystal shutter 45 taken along line B—B of FIG. 6. As shown in FIG. 8, the polarizing plates 60*a* and 60*b* are put on the two liquid crystal cell substrates 45*a* and 45*b* that constitute the liquid crystal shutter 45, facing their surfaces, respectively. Further, a gap of several micrometers is formed in a joint portion 45*c* between the liquid crystal cell substrates 45*a* and 45*b*, and this gap is injected with a liquid crystal.

The driver ICs 55*a*, 55*b* and 55*c* that are mounted on the liquid crystal cell substrate 45*a* apply voltage to the liquid crystal in the joint portion 45*c* through transparent electrodes (not shown) that is formed opposite to each other on the liquid crystal cell substrates 45*a* and 45*b*. The liquid crystal supplied with the voltage functions as a liquid crystal shutter that changes the phase angles of transmitted lights depending on the voltage value and switches on and off the transmitted lights according to the polarization characteristics of the two polarizing plates 60*a* and 60*b*.

Figure 14:
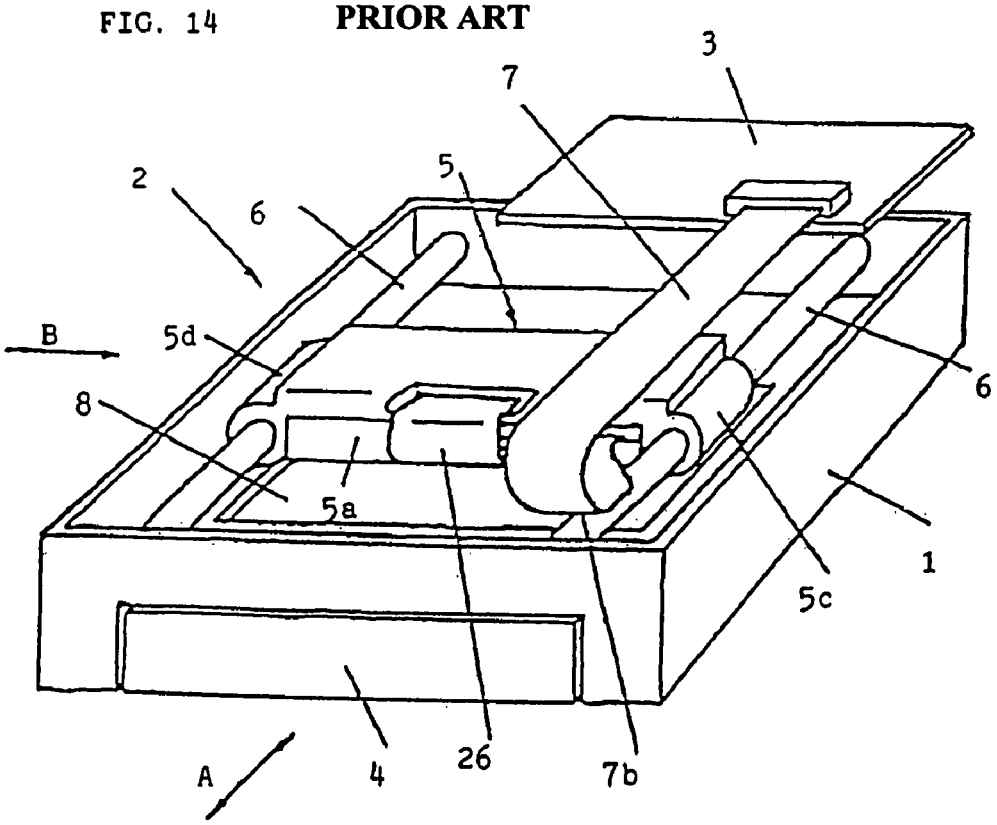
FIG. 14 PRIOR ART
FIG. 14 is a perspective view of an optical printer fitted with the optical printer head of FIG. 13.

Exposure operation of the optical printer head 41 will now be described with reference to FIGS. 5 and 14. When an external circuit (not shown) supplies a control signal to a flexible connecting member 46, a light source 44, which is connected electrically to the flexible connecting member 46, successively emits linear lights of three colors, red, green, and blue, through a light emission window 44*a* in response to the control signal, and irradiates the liquid crystal shutter 45 with them. The liquid crystal shutter 45 receives image data from the external circuit and controls on/off of the linear pixel column alternatively (not shown). In consequence, the linear lights that are modulated by the liquid crystal shutter 45 pass through the opening 42*a* that is situated right under the liquid crystal shutter 45, and are irradiated onto the light receiving surface 51*a* of the lens array 51. Thereupon, an image of one line is exposed to the photoconductor 8 (FIG. 14) that is located at a distance equal to the imaging distance of the lens array 51.

The optical printer head 41 is moved for each line on the photoconductor 8 by means of a scanning motor (not shown). Then, the light source 44 and the liquid crystal shutter 45 are caused by the external circuit to repeat exposure operation in synchronism with the motion of the scanning motor. Thus, plane exposure of an image can be made on the photoconductor 8.

In the present embodiment, the optical printer head 41 is of a line exposure type using the linear liquid crystal shutter 45. Alternatively, however, the optical printer head may be of a plane exposure type such that the light source 44, liquid crystal shutter 45, lens array 51, etc. are arranged in a plane configuration.

If the thickness of the polarizing plate that is put on the liquid crystal cell substrate of the liquid crystal shutter or the thickness of the adhesive agent with which the polarizing plate is bonded changes owing to variation in manufacture or the like, according to the optical printer head of the present embodiment, the distance between the liquid crystal cell substrate and the lens array can be made accurately equal to the proper imaging distance of the lens array. Therefore, the optical printer head can be realized ensuring outstanding resolution and high image quality.

Since the polarizing plate is housed in the second recess in the base of the liquid crystal shutter housing recess, moreover, the vertical thickness of the optical printer head can be reduced at least by a margin corresponding to the thickness of the polarizing plate. This produces an effect to thin an optical printer that is furnished with this optical printer head.

Referring now to FIGS. 9 to 12, there will be described the way the light source 44 that linearly emits a plurality of luminescent colors is housed in the opening 43*a* of the retaining cover 43, in the optical printer head of each of the embodiments described above.

When the light source 44 shown in each of FIGS. 1 and 5 is housed in the opening 43*a* of the retaining cover 43, the light emission window 44*a* in its lower surface must be securely opposed to the opening 42*a* of the frame body 42. Thus, the light source 44 must be accurately positioned in the opening 43*a* of the retaining cover 43. The following is a description of a configuration to attain this.

Figure 9:
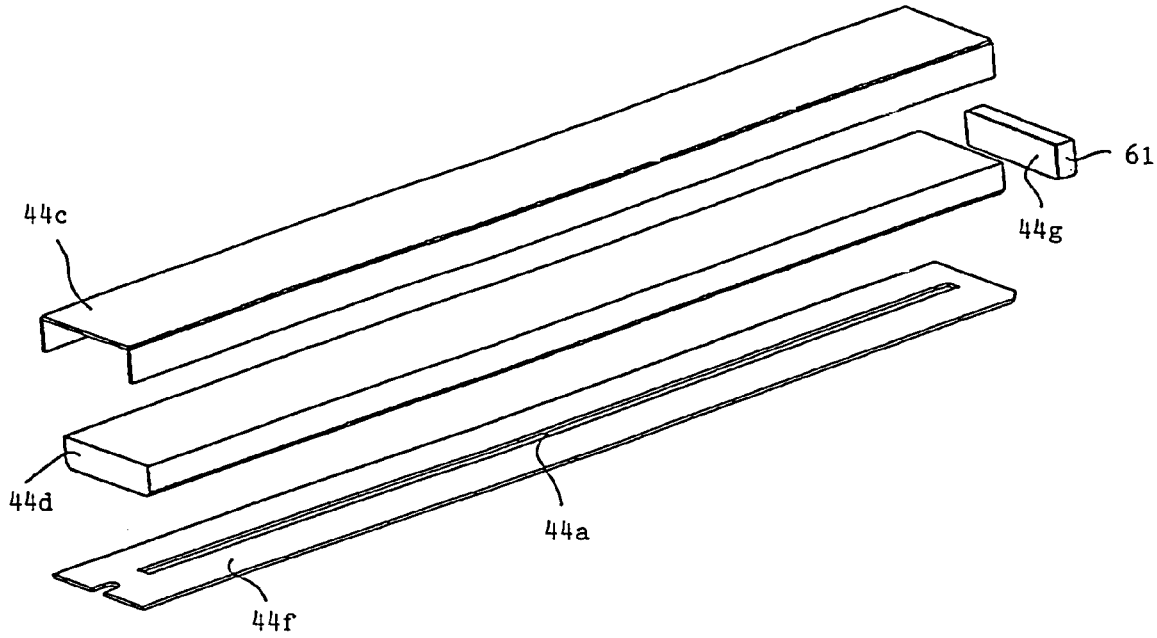
FIG. 9 is perspective view showing a light guide plate used in the optical printer heads of FIGS. 1 and 5, first, second, and third reflecting sheets covering the light guide plate, and a spacer member.

As shown in FIG. 9, the light source 44 is composed of a light guide plate 44*d*, a first reflecting sheet 44*c* that covers the top and side faces of the light guide plate 44*d*, a second reflecting sheet 44*f* that covers the lower surface of the light guide plate 44*d*, and a third reflecting sheet 44*g* that covers one end face of the light guide plate 44*d*.

Figure 10:
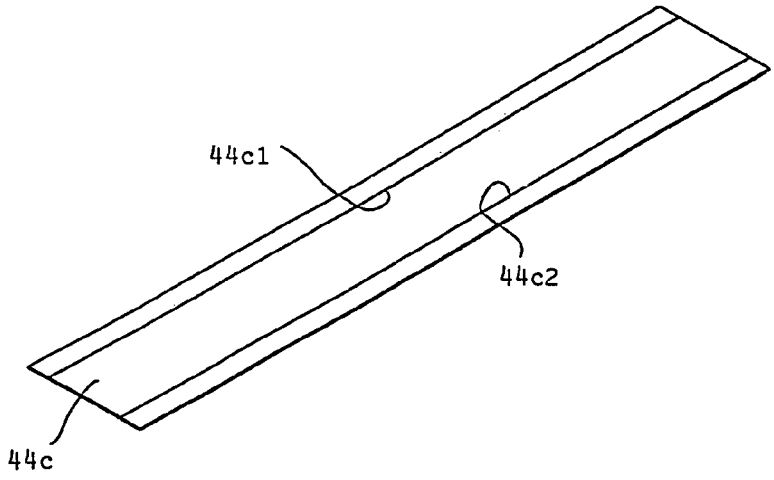
FIG. 10 is a development showing the first reflecting sheet covering the top face and the left- and right-hand side faces of the light guide plate of FIG. 9.

The first reflecting sheet 44*c* that covers the top and side faces of the light guide plate 44*d* is formed by cutting two slits 44*e*1 and 44*e*2 in one reflecting sheet material so as to extend in its longitudinal direction, as shown in FIG. 10, and inwardly squarely turning its left- and right-hand side portions. If the reflecting sheet material is 0.188 mm thick, the appropriate depth of the slits 44*e*1 and 44*e*2 is 0.14 mm or thereabout. The slits 44*e*1 and 44*e*2 serve to make the turned portions of the first reflecting sheet 44*c* perfectly square without becoming curved, so that the sheet 44*c* can be brought fully intimately into contact with the top and side faces of the light guide plate 44*d*. Thus, the light guide efficiency of the light guide plate 44*d* can be improved.

The second reflecting sheet 44*f* that covers the lower surface of the light guide plate 44*d* is formed with a light emission window 44*a* that extends in the longitudinal direction in its central portion. As shown in FIG. 9, moreover, the third reflecting sheet 44*g* that covers the one end face (right-hand end face in FIG. 9) of the light guide plate 44*d* is stuck to one surface of a spacer member 61, which will be mentioned later.

Figure 11:
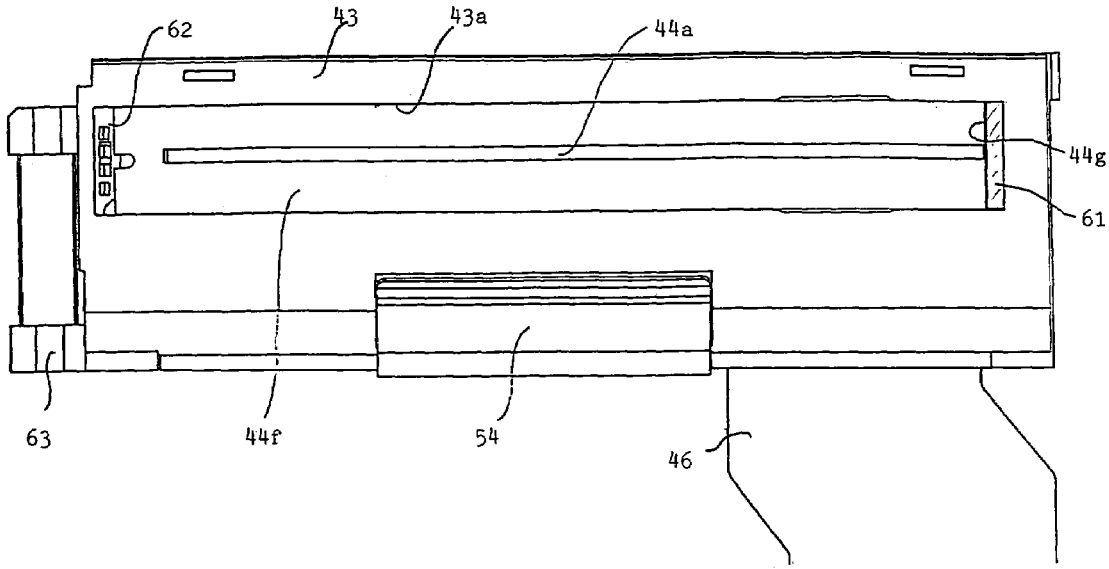
FIG. 11 is a top view showing a state in which the second reflecting sheet covering the lower surface of the light guide plate of FIG. 9 and an integral structure combining the spacer member and the third reflecting sheet covering one end face of the light guide plate are housed in an opening of a retaining cover of the optical printer heads of FIGS. 1 and 5.

FIG. 11 is a top view showing the way the second reflecting sheet 44*f* shown in FIG. 9 is housed in the opening 43*a* of the retaining cover 43 and the spacer member 61 shown in FIG. 9 is located on one end portion (end portion opposite from the end portion that faces an LED 62) of the reflecting sheet 44*f*. In FIG. 11, reference numeral 63 denotes a head base.

Figure 12:
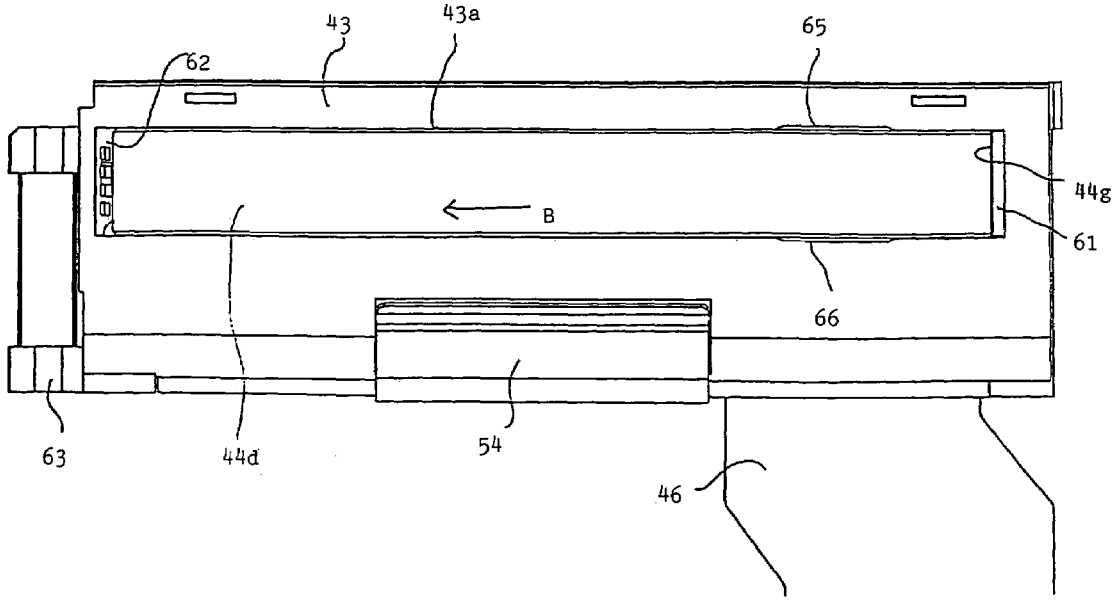
FIG. 12 is a top view showing a state in which the light guide plate of FIG. 9 is placed on the second reflecting sheet of FIG. 11.

FIG. 12 is a top view showing a state in which the light guide plate 44*d* shown in FIG. 9 is put on the second reflecting sheet 44*f* shown in FIG. 11. If the light guide plate 44*d*, besides the second reflecting sheet 44*f* and the spacer member 61, is further incorporated in the opening 43*a* of the retaining cover 43 in this manner, the spacer member 61 is compressed, whereupon the light guide plate 44*d* is pressed against the LED 62 (in the direction of arrow B in FIG. 12) by its reaction force. In consequence, the light guide plate 44*d* is positioned in the opening 43*a* of the retaining cover 43. Since the light guide plate 44*d* is brought close to the LED 62, moreover, the light guide efficiency is improved.

Preferably, the spacer member 61 has a thickness and material such that it is compressed to about 50 to 70% when light guide plate 44*d* is incorporated. For instance, a silicone foaming agent of 1-mm thickness may be used as an example of the spacer member 61. As mentioned before, the third reflecting sheet 44*g* is stuck to the one surface (surface in contact with the light guide plate 44*d*) of the spacer member 61. The third reflecting sheet 44*g*, which is formed by coating PET with aluminum by vapor deposition, may enjoy a thickness of 0.084 mm. The spacer member 61 with reflecting sheet, having a given width and height, as shown in FIG. 9, can be obtained by press-cutting of an integral structure that is formed by joining the spacer member 61 and the third reflecting sheet 44*g* with a double-coated tape.

The top face and the opposite side faces of the light guide plate 44*d* shown in FIG. 12 must be further concealed under the first reflecting sheet 44*c* shown in FIG. 9. However, only a gap for the thickness of the first reflecting sheet 44*c* is formed between the side faces of the light guide plate 44*d* and the inner wall surface of the opening 43*a* of the retaining cover 43. It is very difficult, therefore, to insert the first reflecting sheet 44*c* of FIG. 9, which covers the side faces of the light guide plate 44*d* as well as its top face, into the gap to be directed toward the LED 62 from above the spacer member 61.

Thereupon, recesses 65 and 66 are formed individually in those regions of the left- and right-hand inside walls of the opening 43*a* of the retaining cover 43 which are situated near the spacer member 61, as shown in FIG. 12. If the first reflecting sheet 44*c*, which covers the top and side faces of the light-guide plate 44*d*, is inserted for a short length into gaps between the side faces of the light guide plate 44*d* and the inside walls of the opening 43*a* of the retaining cover 43, in this arrangement, the distal end corner portions of the first reflecting sheet 44*c* on the insertion side temporarily get into the recesses 65 and 66, so that the first reflecting sheet 44*c* can be easily inserted deeper thereafter.

The invention claimed is:

1. An optical printer head which comprises a liquid crystal shutter and a frame body that houses the liquid crystal shutter, and irradiates the light which has passed through said liquid crystal shutter to a photoconductor through a lens array, wherein said liquid crystal shutter has a structure such that a polarizing plate smaller than a liquid crystal cell substrate is put on the liquid crystal cell board, said frame body includes a base portion having an opening through which light passes and a liquid crystal shutter housing recess formed over said base portion, the bottom portion of the liquid crystal shutter housing recess is formed with a polarizing plate housing portion composed of a space large enough to house said polarizing plate, said lens array is located on the underside of said base portion, said liquid crystal shutter is positioned such that it comes into contact with the bottom of the liquid crystal shutter housing recess in said base portion; and said polarizing plate is adapted to be housed in the polarizing plate housing portion so that the liquid crystal cell substrate is positioned with respect to said lens array when the liquid crystal shutter is housed in the liquid crystal shutter housing recess.

2. The optical printer head according to claim 1, wherein said frame body has a lens array housing portion in a position corresponding to said opening under the base portion so that the light which has passed through said liquid shutter may pass through the lens array.

3. The optical printer head according to claim 1, wherein an elastic body and an adjusting screw are arranged on one and the other, respectively, of two opposite wall surfaces of the liquid crystal shutter housing recess so that the position of the liquid crystal shutter in the liquid crystal shutter housing recess is adjusted using the elastic body and the adjusting screw.

4. The optical printer head according to claim 3, wherein said elastic body abuts against a part of the liquid crystal shutter housed in the liquid crystal shutter housing recess.

5. The optical printer head according to claim 4, wherein said elastic body abuts against a substantially central portion of the liquid crystal shutter housed in the liquid crystal shutter housing recess.

6. The optical printer head according to claim 3, wherein a plurality of said adjusting screws are provided.

7. The optical printer head according to claim 6, wherein said adjusting screws are two in number and are located individually in two symmetrical points in a position where the elastic body abuts against the liquid crystal shutter.

8. The optical printer head according to claim 3, wherein said liquid crystal shutter has a linear pixel column, the lens array has a linear light receiving surface, and the position of said liquid crystal shutter is adjusted so that the respective lines of the liquid crystal shutter and the lens array are coincident with each other.

9. The optical printer head according to claim 1, wherein said liquid crystal shutter is connected with a flexible connecting member for connection with an external circuit, the flexible connecting member is led out from one wall surface side of the liquid crystal shutter housing recess, the elastic body is located on the wall surface of the liquid crystal shutter housing recess on the side from which the flexible connecting member is led out, and the adjusting screw is located on the wall surface on the opposite side.

10. The optical printer head according to claim 1, wherein said frame body is covered by a retaining cover, and the retaining cover is formed with an opening containing a light source, a light guide for linearly converging light from the light source, a plurality of reflecting sheets covering the surface of the light guide, and a spacer member having elasticity to press the light guide toward the light source.

11. The optical printer head according to claim 10, wherein one of said plurality of reflecting sheets is formed into a reflecting sheet for covering the top face and the opposite side portions of the light guide plate by cutting two slits in one sheet material so as to extend in the longitudinal direction thereof and inwardly squarely turning the opposite side portions thereof.

12. The optical printer head according to claim 11, wherein said inner wall of the opening in the retaining cover is formed with recesses for receiving the insertion-side corner portions of the reflecting sheet.

13. The optical printer head according to claim 10, wherein said reflecting sheet is stuck to that surface of the spacer member which faces the light guide.

* * * * *